US005806710A

United States Patent [19]

Shiffer et al.

[11] Patent Number: 5,806,710

[45] Date of Patent: Sep. 15, 1998

[54] CONTAINER AND CLOSURE LID

[76] Inventors: David A. Shiffer, 6119 N. Ludlow Rd., Cable, Ohio 43009; David O. Allen, 1594 Wayne Rd., Wilmington, Ohio 45177

[21] Appl. No.: 557,334

[22] Filed: Nov. 14, 1995

[51] Int. Cl.[6] ..... B65D 41/48

[52] U.S. Cl. ..... 220/785; 270/791; 270/801; 270/805; 270/270

[58] Field of Search ..... 220/319, 780, 220/783–785, 787–793, 797–801, 805, 265, 268, 269, 270, 276, 266; 215/303, 298, 250; 229/96.1, 160.2

[56] References Cited

U.S. PATENT DOCUMENTS

| | | | |
|---|---|---|---|
| D. 320,560 | 10/1991 | Allen . | |
| 3,381,872 | 5/1968 | Holder et al. | 220/785 X |
| 3,566,946 | 3/1971 | MacDonald | 220/783 |
| 3,902,619 | 9/1975 | Gouget | 215/50 |
| 4,043,482 | 8/1977 | Brown | 220/783 |
| 4,180,179 | 12/1979 | Hoenig et al. | 220/783 |
| 4,244,920 | 1/1981 | Manschot et al. | 220/793 X |
| 4,426,014 | 1/1984 | Coltman, Jr. | 220/789 |
| 4,449,641 | 5/1984 | Jorgensen et al. | 220/783 |
| 4,453,647 | 6/1984 | Neat | 220/783 X |
| 4,467,938 | 8/1984 | Allen . | |
| 4,512,493 | 4/1985 | Von Holdt . | |
| 4,840,289 | 6/1989 | Fait et al. | 220/276 X |
| 4,887,735 | 12/1989 | Dudzik | 220/789 |
| 5,125,530 | 6/1992 | Straub | 220/783 |
| 5,437,386 | 8/1995 | Von Holdt | 220/783 |
| 5,573,134 | 11/1996 | Chenault et al. | 220/319 X |

FOREIGN PATENT DOCUMENTS

| | | | |
|---|---|---|---|
| 2227481 | 8/1990 | United Kingdom | 220/783 |

*Primary Examiner*—Allan N. Shoap
*Assistant Examiner*—Nathan Newhouse

[57] ABSTRACT

This invention provides a container and closure lid particularly suitable for packaging semi-solids and liquids which are to be frozen. The closure lid fits entirely into the mouth of the container, providing no easy method of removal absent use of a pull tab which incorporates a tamper-evident frangible pin. The closure lid incorporates a generally flat sided seal skirt which mates with a U-shaped seal channel on the container inner wall surface to prevent leakage past the seal skirt and a locking ridge having a flat top which mates with a locking ledge face on the container inner wall surface adjacent the container mouth. The seal skirt snaps under and is covered by the locking ledge to provide no purchase along the lid edge. The container seal channel not only provides part of the sealing mechanism of the invention but also prevents translation of the lid toward the container bottom while the container locking ledge prevents translation of the lid toward the container mouth. This back-to-back relationship enhances the positive positioning of the closure lid on the container even during freeze\thaw expansion and contraction of the contents. In one embodiment, the container incorporates a dimple ring as part of the seal channel which provides an interference fit to the inserted closure lid seal skirt, pressing the seal skirt against the opposing wall of the seal channel, thereby providing two regions of sealing between the seal channel and the inserted seal skirt.

5 Claims, 4 Drawing Sheets

CONTAINER AND CLOSURE LID

TECHNICAL FIELD

The present invention relates to a resealable container and closure lid assembly. Specifically, the invention relates to a container seal ring and a closure lid, each constructed from plastic, which are particularly useful for packaging semi-solids and liquids which are subsequently frozen.

PROBLEM

Packaging technology continues to develop ways to reduce costs or improve the shelf life of consumer food products. However, certain food stuffs have proven difficult in adapting to new container packaging.

For example, frozen juices such as apple, orange, lemonade, and grape have been conventionally packaged in spiral- wrapped paper containers with metal lid ends. Because of the spiral construction, the paper portion of the container is limited to a cylindrical shape with two open ends. A generally flat metal lid is attached to and occupies each open end of the cylinder, closing the circular opening. Each metal lid is held in place and sealed to the paper body by a gripping ring which extends about the periphery of the metal lid forming a shallow channel, the sides of which are compressed against the circular paper mouth edge. Typically, for the metal lid which is to be removed to open the container, a plastic pull tab is interposed in the gripping ring channel between the paper mouth and the ring inner surface with a portion of the tab end protruding outside the gripping ring. The lid is removed by pulling the protruding tab end which, as it is pulled from the ring channel, causes the ring channel to widen and release the captured paper of the container end.

Unfortunately, containers of the above described construction have drawbacks. First, the spiral wound paper construction of the container body limits the ability to vary the shape of the container. Second, the dissimilar materials used in constructing the container and the lid do not lend themselves to a simple single manufacturing method. The metal end lids require different equipment for manufacture from that required to produce the paper body. Third, because of the method of separating the lid from the body when opening the container, it cannot be reclosed once opened. Fourth, the tab used in separating the lid from the body of the container is often frustrating to use since it provides little purchase, particularly when damp. Fifth, the container shape does not lend itself to easy stacking, each end is of the same dimension which does not provide any stackable feature to hold one end of one container in position atop one end of another container.

Plastic containers are, relatively speaking, a recent packaging innovation which have had wide acceptance with applications spanning a diverse range of contents. However, the current plastic container designs suffer from deficiencies of their own, particularly in food stuffs applications and even more particularly in relation to frozen juice packaging and other liquids and semi-solids which are frozen after packaging.

Conventional plastic frozen food containers are bowl-like in configuration with the open mouth characterized by a relatively thicker rim lip which is rolled outwardly from the container interior to form a locking ring on the container exterior. The container lid conforms in shape to that of the container mouth and has a skirt surrounding its periphery with a locking ledge formed on the inner surface of the skirt. The lid skirt translates over and down past the container lip until the locking ledge slips under the container locking ring in an interference fit.

With increased concern among consumers over product tampering, conventional lids which can be easily removed without telltale signs of tampering are inadequate for packaging food stuffs. Since conventional plastic container lids are placed over and about the open mouth of the container, they provide excellent purchase for separating the lid from the container and thereafter permit replacement without evidence of removal. Consequently, any such lid design is less desirable for food product applications and frozen juices in particular.

The art also discloses lids which are adhered to the container either by using an adhesive or by heating the container mouth and/or lid rim so that the lid is permanently bonded to the container. In these applications, the lids are made to be frangible along some determined path to permit some portion of the lid to be separated from the remaining portion which includes the portion adhered to the container. Frangible lids suffer from several inadequacies. First, frangible lids are not resealable, once the lid portions are separated, the lids have no ability to lock back in position and, more importantly, to reseal. Second, in applications for liquids and semi-solids which are subsequently frozen,the lid's frangible path is inset from the mouth of the container to avoid being affected by the adhesive or the heat melt sealing of the lid to the container. While this construction may aid in preserving the integrity of the frangible path, it results in a substantial lip being created which protrudes inwardly from the container wall toward the center of the container. This protrusion interferes with the ejection of the contents as they are squeezed, shaken or poured from the container.

Both conventional locking lid and adhered frangible lid designs have proven unsatisfactory in maintaining seal integrity for applications where the packaged liquid or semi-solid is frozen. During freezing the liquid expands to a volume greater than in its liquid state, then subsides to a slightly lesser volume than that achieved at freezing. With a conventional locking lid, expansion will cause the contents to ooze between the lid and the container mouth and past the locking elements because the construction and contour of the container lip and the lid do not possess a strong sealing element. With a frangible lid, the expansion of the contents stresses the frangible path and too often results in the frangible path splitting.

SOLUTION

The above problems are solved and an advance is made over the prior art in accordance with my invention wherein a novel container and lid are provided which provide a watertight seal between the container and the lid even during freezing and thawing. The lid and container seal ring are both constructed of plastic and interlock and seal in such a manner that is highly tamper resistant. Moreover, the lid of my invention incorporates a tamper-evident pull tab providing the consumer visual evidence that the contents may be suspect if the tab has been moved from its normal position. The container and lid are constructed in such a fashion that a liquid may be packaged without an air space and without affecting container/lid integrity or sealing.

These novel features are accomplished in the present invention by forming both the container, or at least the container locking ring, and the container lid from a plastic such as, for example, polyethylene, polypropylene, polycarbonates and nylon, by injection molding.

In forming the container, two locking zones are formed. The first zone is a locking ledge about the circumference of the interior wall of the container at its rim or mouth. The locking ledge is formed about the circumference of the interior wall of the container adjacent the rim and projects inwardly a relatively short distance toward the centerline of the container to form on the ledge down side, that is, the ledge side facing the bottom of the container, a flat locking surface perpendicular to the centerline of the container. The locking ring can be segmented or continuous.

The second container locking zone is a seal channel which is formed some distance further down along the container interior wall from the container mouth and the locking ring. The seal channel also extends about the circumference of the container interior wall and is generally parallel to the locking ring and perpendicular to the centerline of the container. The seal channel is a stepped, depressed element, generally U-shaped in cross-section, having an exterior wall, an interior wall and a seal base between the two. In one embodiment, the seal channel is augmented by a dimple ring in approximately the same plane as the terminal end of the inner seal channel wall.

Turning attention to the container lid, its configuration is complimentary to that of the container mouth. In the instance where the container mouth is circular, the container lid has a substantially disk-shaped main body. About the circumference of the body is a raised tab wall. In the preferred embodiment, from the upper termination of the tab wall, extending outward in relation to the lid main body is a connecting ring platform which matches the configuration of the container lid, is flat in contour and parallel to the lid main body. At the outer circumference of the connecting ring platform, extending upwardly therefrom, is a locking ridge which has an inner wall and an outer wall, the outer wall conforming in configuration and contour to that of the container interior wall. At the locking ridge terminal end, a ridge face is positioned between the inner and outer ridge walls. The ridge face is generally flat in contour and is in a plane parallel to the connecting ring platform. The locking ridge can be segmented or continuous.

Also at the outer circumference of the connecting ring platform is a seal skirt which extends downwardly and generally perpendicular to the connecting ring platform and which has an inner wall and an outer wall, the outer wall conforming in configuration and contour to that of the container interior wall. At the seal skirt terminal end, a seal face is positioned between the inner and outer seal skirt walls. The seal face is generally flat in contour and is in a plane parallel to the connecting ring platform.

The locking ridge face and the seal face are of complementing configuration and contour to, respectively, the locking surface of the container locking ledge and the seal channel of the container. The outer wall of the locking ridge and the outer wall of the seal skirt likewise are of complementing configuration and contour to the container inner wall surface between the locking ledge and the seal channel.

At one location along the inner circumference of the connecting ring platform is a pull tab or ring extending inwardly toward the center of the lid, above and generally parallel to the lid main body. At one or more locations along the length of the pull tab or ring is a pin extending between the tab and the lid main body. The pin is frangible at one or more locations which will separate when the pull tab is shifted some distance from its normal at-rest position providing a clear indication of tampering.

The elements of the container lid are complementarily dimensioned with respect to their respective counterparts on the container. When the container lid is inserted into the container mouth, the lid seal skirt is seated in sealing relation in the container seal channel and the lid locking ridge snaps under the container locking ledge such that the ridge face presses against the locking surface of the locking ledge. Further, the outer walls of the locking ridge and the seal surface contact and press against the container inner wall between the two locking zones.

In the above described alternative embodiment of the container having a dimple ring, the dimple ring adds additional sealing strength by pressing against the outer wall of the lid seal skirt. Not only does this interference fit provide additional sealing at the outer wall of the sealing channel but the pressure of the dimple against the seal skirt presses the inner surface of the seal skirt against the inner surface of the seal channel to thereby improve the sealing therebetween. This structure creates a sufficient seal between the lid and the container that the seal face of the lid seal skirt need not seat against the seal base of the container seal channel.

The connection between the container and the container lid which is thereby formed provides a water-tight seal which cannot be easily opened without use of the pull tab on the lid. But, use of the pull tab in an attempt to unlock and unseal the lid from the container will separate the frangible pin providing clear indication of tampering. Moreover, the pull tab permits the lid locking ridge and seal surface to be dislodged from their respective container counterparts and provides a convenient purchase point to remove the lid completely from the container. Advantageously, the various elements can be sized to be quite small yet provide the necessary sealing and locking features. This contributes to the ease with which the contents, frozen or otherwise, can be removed from the container. A container of the instant invention requires only a slight flair from container bottom to mouth to permit removal of frozen contents without interference by the sealing and locking elements. By use of a flexible plastic to construct the container and lid of proper thickness, the container can be completely filled with liquid or semi-solid and the lid locked in place without the need to provide an air space between the contents and the lid. The lid and container will withstand the expansion of the liquid as it freezes without damage and the unique back-to-back arrangement of the locking and sealing elements prevent the lid from unlocking or unsealing during the freezing process.

While the instant invention has been described in terms of application to frozen liquids, notably juices, there are many other useful applications to which the instant invention easily lends itself.

Moreover, while the instant invention has been described as having both the lid and the container made completely of plastic, this is not essential to the practice of the invention. For example, rather than constructing the container entirely from the same material or as a single piece, a separate plastic ring can be formed which incorporates both sealing zones described for the container and this ring adhered to a container of any material desired. Such materials could, for example, be the same plastic as that used in constructing the ring containing the sealing zones, dissimilar plastic, paper or metal. Thus, the instant invention provides a much simplified attachment and seal between lids and containers of a variety of materials and of a variety of designs.

In accordance with one aspect of the invention, a closure lid is placed completely within the mouth of the container to be closed.

In accordance with another aspect of the invention, a closure lid is constructed with a locking ridge and the container with a complementing locking ledge to prevent outward movement of the lid from the container mouth once closed.

In accordance with yet another aspect of the invention, a closure lid is constructed with a seal skirt and the container with a complimenting sealing channel which interact and seat against one another to prevent not only inward movement of the lid from the container mouth once closed but also egress of the contents from the container.

In accordance with a further aspect of the invention, a pull tab is integral with the closure lid in such a relation with one portion of its outer circumference that it provides purchase for dislodging the sealing and locking elements from one another between the lid and the container so that the lid can be pulled free from the container and from the contained frozen liquid.

In accordance with a still further aspect of the invention, a pin resides between the pull tab and the lid body which is easily frangible yielding ready evidence of use of the pull tab and hence tampering.

In accordance with another further aspect of the invention, the sealing zones associated with the container are constructed separately from the remainder of the container and attached thereto to permit the container to be formed in separate pieces or of dissimilar materials.

DETAILED DESCRIPTION

Figure 1:
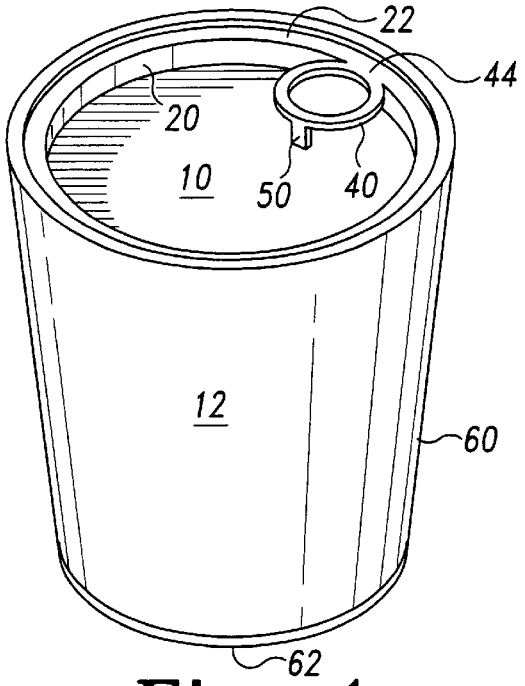
FIG. 1 is a front isometric of the lid and container of the instant invention with the lid locked on position.

Referring now to the drawings in detail, FIGS. 1–11 inclusive illustrates a first preferred embodiment of the container and lid of the instant invention, the closure elements of which are injection molded from a thermoplastic material, such as low density polyethylene, linear low density polyethylene, high density polyethylene, polypropylene, polycarbonates, nylon or other suitable moldable plastic material.

The Closure Lid

Figure 2:
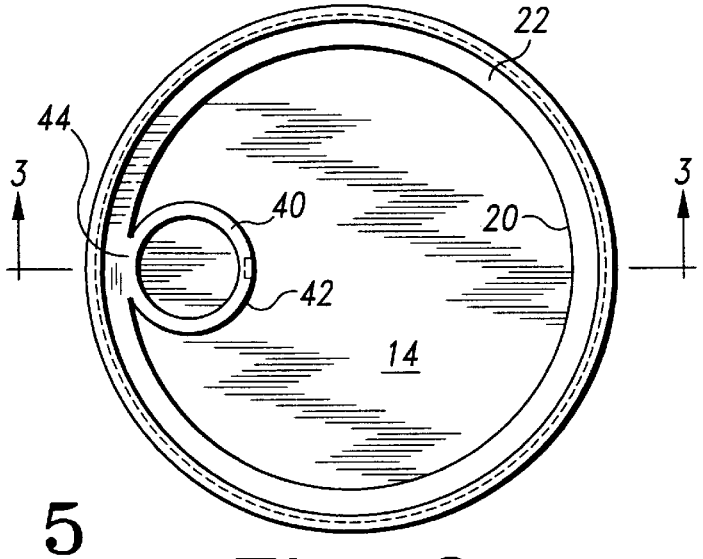
FIG. 2 is a top view of the closure lid and container.
Figure 3:
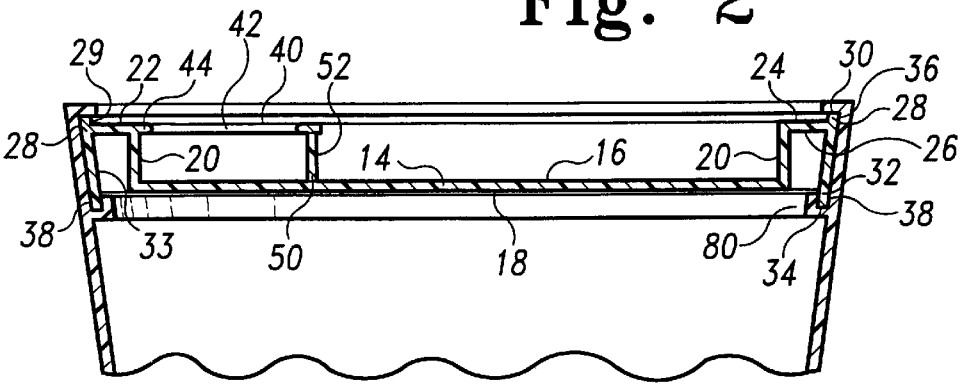
FIG. 3 is a cross section of the closure lid and container taken along line 3—3 in FIG. 2.

FIGS. 1–6 show a circularly shaped closure lid 10, although closure lid 10 could be any shape depending on the shape of the container 12 to which it is mated. As shown in FIGS. 2&3, closure lid 10 includes a central main body 14, having a top and bottom surface 16 & 18 respectively. Central main body 14 is relatively flat in contour and generally disk shaped, with the center point of the closure lid 10 corresponding to the center point of the central main body 14. The top 16 and bottom 18 of the central main body 14 are relatively flat and smooth. This inhibits contained materials, such as frozen juice, from adhering to the lid bottom 18 facilitating removal of the lid from the container 12. The periphery of central main body 14 rises to form a tab wall 20. The tab wall 20 is annular in configuration, extending substantially perpendicular to the central main body 14 from the main body top surface 16. At the distal end of tab wall 20 is an annular surround platform 22, having an upper surface 24 and a lower surface 26, which extends substantially perpendicular to the tab wall 20 and in a direction away from the main body 14.

A pull tab 40 is located at least one position along tab wall 20. In the preferred embodiment, the pull tab 40 is made up of a generally circular ring 42 inset some distance from the tab wall 20 toward the center point of lid main body portion 14 but attached by a connecting band 44 at or near the intersection of the surround platform 22 and the tab wall 20. Connecting band 44 is a generally planar element of approximately the same thickness as the other surface features of the container lid 10. The location of the pull tab 40 takes advantage of the double angle created at the intersections of the tab wall 20 with surround platform 22 and the tab wall 20 with main body 14 which can be seen in cross-section in FIG. 3&4. This double angle allows flexure at both intersections and facilitates movement of tab 40 toward the center point of the lid.

Figure 5:
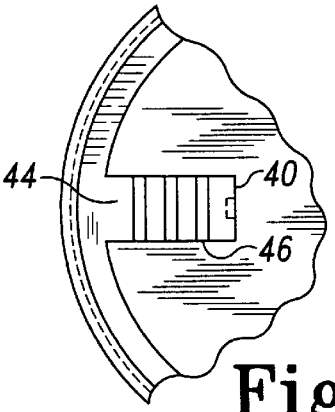
FIG. 5 is a partial top view of the lid showing an alternative pull tab design.

While the preferred embodiment of the pull tab is described above, the invention extends to any pull tab configuration which permits grasping the pull tab and its movement toward the centerpoint of the lid and upward from the lid main body 14. As shown in FIG. 5 other tab designs are known, each of which may have an advantage in certain applications, As shown in FIG. 5, this alternative embodiment of the pull tab 40 utilizes no tab ring, but incorporates a ribbed upper surface 46 and lower surface (not shown). The ribbed upper and lower surfaces provide a non-slip gripping surface to facilitate movement of the pull tab 40. While two configurations for the pull tab 40 are shown, it is appreciated that the pull tab 40 can be of various configurations including, for example, a pull ring, a flat tab with a balloon end, and a T-grip style. In each configuration, the pull tab 40 is connected to the tab wall along a sufficient length to forestall the tab from tearing away under the tension expected to be required to remove the lid 10 from the container 12 when sealed and locked together.

Located along the length of pull tab 40 is a pin 50 which is connected to both the pull tab 40 and the lid main body 14. The pin 50 is provided with a frangible zone 52 which is thinner than the remainder of the pin 50. Although only a single frangible zone is shown in the preferred embodiment, several such zones could be used, for instance at the intersection between the pin and the pull tab and the pin and the main body. In the preferred embodiment, the pin 50 is located at the farthest point along pull tab ring 42 from tab wall 20 so that lifting or movement of the pull tab 40 from its normal at-rest position results in the separation of the pin so that it is no longer a single piece. The location of the frangible pin can be varied to meet different pull tab designs and desires of the container manufacturer. Pin 50 need only be positioned such that it will be placed in tension in the event of movement of the pull tab 40 away from its at-rest position and sized such that its frangible zone 52 has a desired tensile strength. Once the tensile strength of frangible zone 52 is overcome, the pin 50 will separate and this division provides clear visual evidence of use or tampering to consumers.

Figure 4:
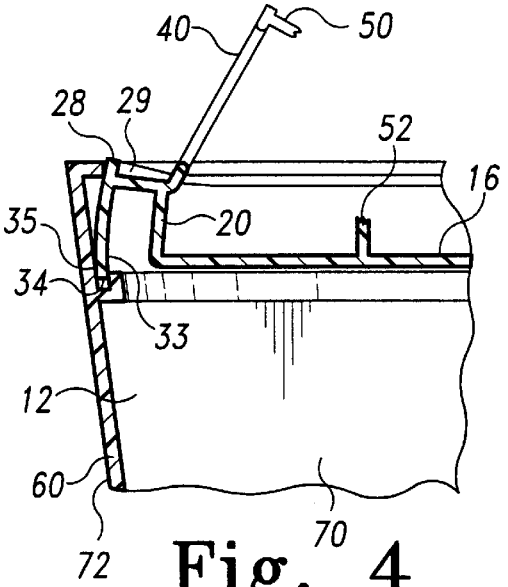
FIG. 4 is a partial cross section also taken along line 3—3 in FIG. 2 showing the frangible pin separated and the tab wall flexed to cause the lid locking ridge to move inwards of the locking ledge for removal of the lid from the container.
Figure 6:
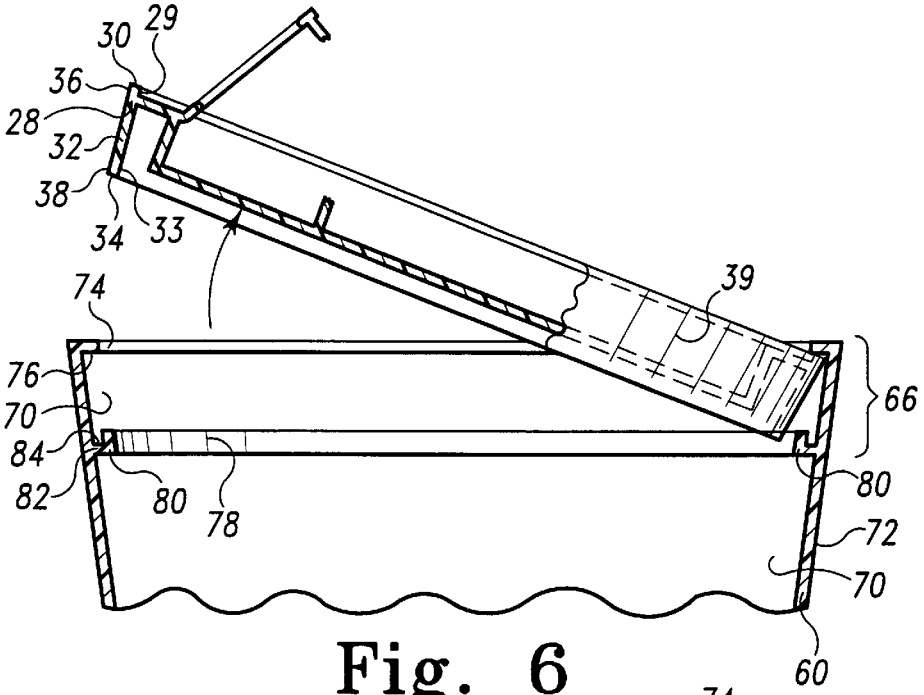
FIG. 6 shows in cross section the lid released from the container.

Returning attention to the annular surround platform 22, as shown in FIGS. 3, 4&6, at the outer periphery of the platform 22, an annular locking ridge 28, having an inner wall 29 and an outer surface 38 extends upwardly substantially perpendicular to the upper surface 24 of the platform 22. The locking ridge 28 is approximately the same thickness as the rest of the closure lid and terminates in a locking face 30 of generally flat configuration. The locking face 30 is substantially parallel to the plane of lid main body 14.

As shown in FIGS. 3, 4&6, also at the periphery of the platform 22, an annular seal skirt 32, having an inner wall 33 and an outer surface 38, extends downwardly substantially perpendicular to the lower surface 26 of platform 22. The seal skirt is approximately the same thickness as the rest of the closure lid and terminates in a seal face 34 of generally flat configuration. The seal face 34 is substantially perpendicular to the centerline of the lid.

In the preferred embodiment, peripheral outer surface 36 of locking ridge 28 and peripheral outer surface 38 of seal skirt 32 form a seal wall which slopes outwardly at an angle of approximately 92–93 degrees with respect to the plane of the main body 14. While not essential to the practice of the instant invention, in the embodiment shown in FIG.6, the outer surfaces 36&38 have raised tapered ribs 39 which hold the outer surfaces 36&38 away from and provide a slight gap between the main portion of outer surfaces 36&38 and a container inner wall to facilitate insertion of the closure lid 10 into the container 12 by creating vents therebetween for air to escape as the lid is being pressed home on the container.

Figure 7:
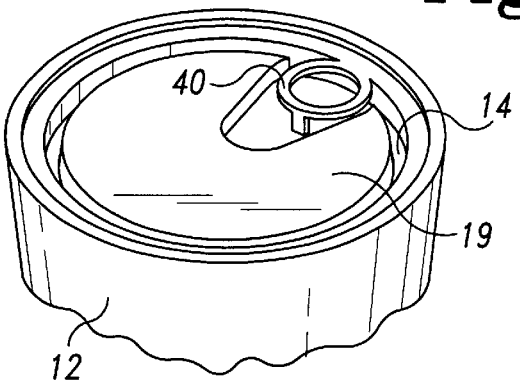
FIG. 7 illustrates an alternative lid embodiment in which the main body of the lid is raised to protect the pull tab from unintentional movement.

As shown in FIGS. 7–11, it is not essential to the practice of the instant invention for the main body 14 of the closure lid 10 to be without contour. As shown in FIG.7, main body can, for example, incorporate a raised central platform 19 which increases the volume enclosed by the lid 10 and the container 12 and which provides some protection for pull tab 40 against inadvertent movement.

Figure 13:
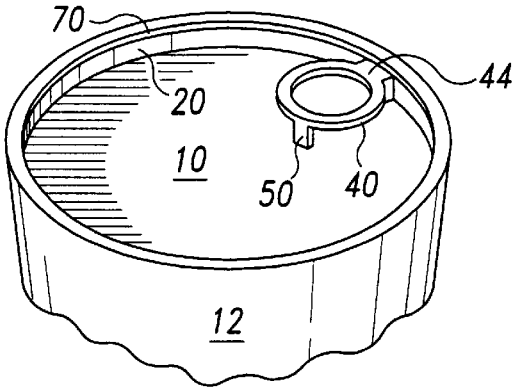
FIG. 13 is a second alternative embodiment of the closure lid of the instant invention which eliminates the container ring platform, the locking ridge and seal skirt being formed on the terminal ends of the tab wall.
Figure 15:
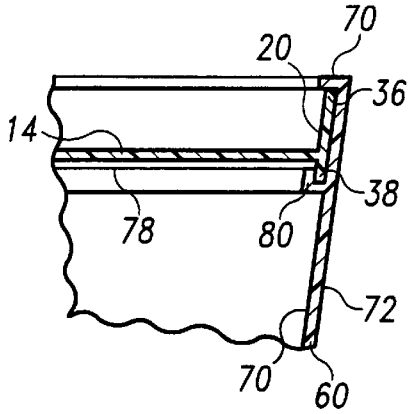
FIG. 15 is a partial cross section of the closure lid second alternative embodiment taken along line 15—15 in FIG. 14.
Figure 14:
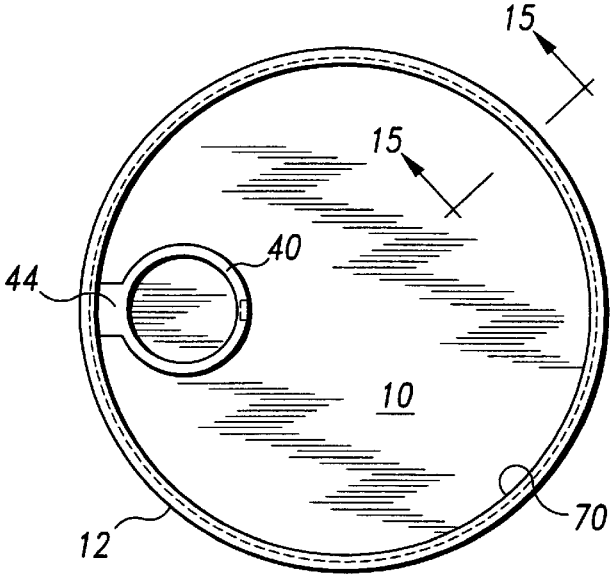
FIG. 14 is a top view of the closure lid of the alternative embodiment of FIG. 13.
Figure 16:
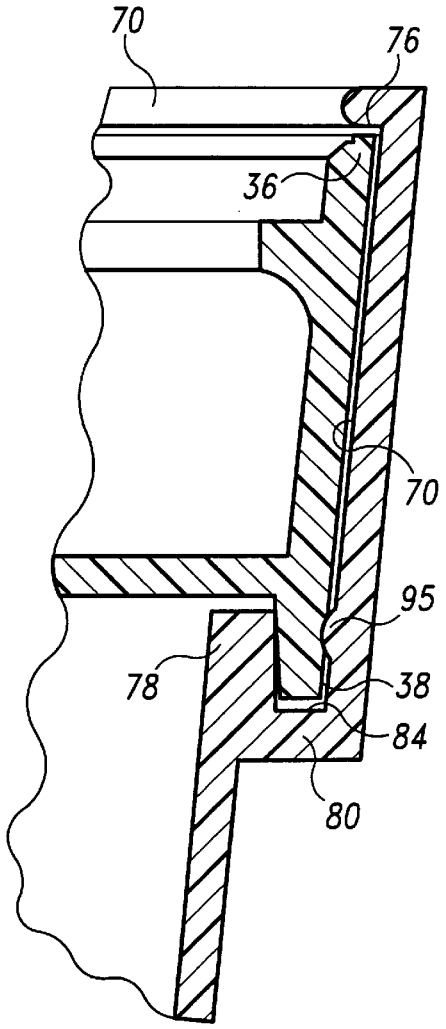
FIG. 16 is cross section of a container of a second alternative embodiment utilizing a dimple ring as part of the sealing element.

Further, as shown in FIGS. 13–15, a second alternative embodiment of the instant invention is shown which does not incorporate the surround platform 22. Instead, the locking ridge 28 and the seal skirt 32 are extensions of the tab wall 20 at its distal end and at its base, respectively, as is more clearly shown in FIG. 15. While this embodiment does not allow the double angle flexure of the preferred embodiment of FIGS. 1–6, it is less complicated to construct and will likewise create an effective locking seal.

The Container

Turning attention to the container 12 of the instant invention, container 12 incorporates elements which complement those locking and sealing elements making up the novel lid design. As mentioned with respect to the lid 10, the container 12 in the embodiments shown in FIGS. 1–16 is generally circular in configuration but could be of any practical configuration without affecting the practice of the instant invention. In the preferred embodiment shown in FIGS. 1–6, container 12 is generally circular in cross-section taken perpendicular to its centerline and wall 60 is sloped slightly outwardly from closed bottom 62 to the open container rim or mouth (unnumbered) defined by the termination of the container outer wall surface 72 and container inner wall surface 70. The inner wall surface 70 and outer wall surface 72 both conform with this slope.

As more clearly shown in FIG. 6, commencing at the container mouth and extending some distance back along the length of container 12 is a portion of the container subsequently referred to as a lid ring 66.

Referring to FIG. 6, in forming the container lid ring 66, two locking zones are formed. The first zone is a locking ledge 74 extending about the circumference of the inner wall surface 70 of the container 12 adjacent its mouth in a plane substantially perpendicular to the centerline of the container. The locking ledge 74 protrudes inwardly from the inner wall surface 70 toward the centerline of the container for a distance approximately equal to the width of the locking face 30 of the lid locking ridge 28. The ledge lower face 76, that is, the surface of the locking ledge facing toward container closed bottom 62, is substantially flat in contour. Thus, when the locking ledge 74 and locking ridge 28 are positioned adjacent one another, ledge lower face 76 and ridge locking face 30 are in pressing relationship against one another. Dimensionally, the circumference of the container and that of the lid are likewise complementary such that on insertion of the lid into the container, the ridge will snap under the locking ledge such that ridge outer surface 36 pressingly resides against container inner wall surface 70 with ledge lower face 76 and ridge locking face 30 adjacent one another. This pressing relationship improves the lock between the lid and the container improving the mechanical connection to the point that it is extremely difficult to remove the ridge from beneath the ridge at any point about their circumference absent use of the pull tab 40

Figure 11:
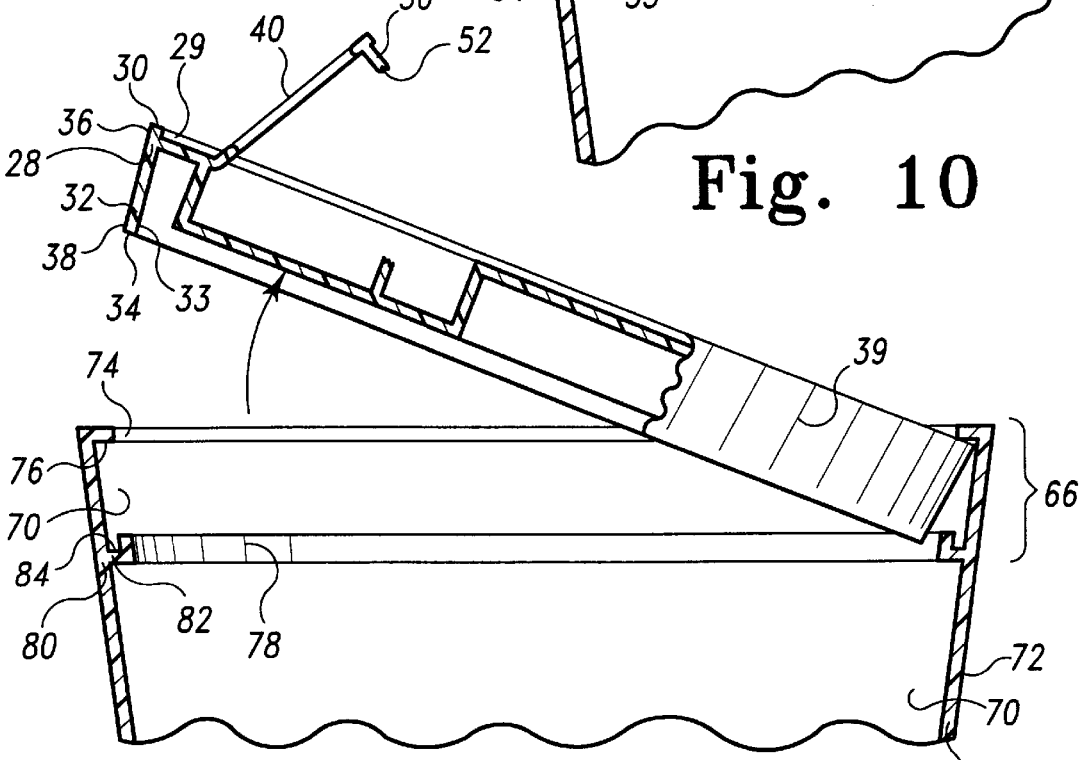
FIG. 11 shows in cross section the lid released from the container of the alternative embodiment.

Some distance down wall 60 from the container mouth, and hence some distance from locking ledge 74, is the second locking zone of seal ring 66, comprised, in the embodiment shown in FIGS. 1–11 and as is more clearly shown in FIGS. 6&11, of a seal channel 80 the plane of which is substantially perpendicular to the centerline of the container 12. The seal channel 80 is defined by container inner wall surface 70, a channel base 82 and a seal ring 78. The channel base extends inwardly about the circumference of the container inner wall surface 70 toward and substantially perpendicular to the centerline of the container. At the inner-most circumference of the channel base 82, a seal ring 78 extends a short distance upwardly toward the mouth of the container. The inner surface of the seal base 82 forms a seal face 84 which is relatively flat and perpendicular to the centerline of the container. Thus, the seal channel opens toward the open top 64 of container 12. The seal channel is thusly positioned parallel to the locking ledge at a greater depth from the container mouth than the locking ledge.

The container closure lid 10 is inserted into the container 12 at a slight angle which permits the lid annular seal skirt 32 to be inserted into the open seal channel 80 at one location and, as continued pressure is applied against the closure lid outside surface, allows the skirt to translate along and progressively seat in the seal channel 80 such that seal face 34 is pressed against the bottom of seal channel 80. At the same time, the seal skirt outer surface 38 and locking ridge outer surface 36 contact and translate down along the container inner wall surface 70.

Returning to the closure lid 10, as was mentioned earlier, to permit air to escape as the lid 10 maneuvers into position, outer seal surface ribs 39 are spaced in raised relation about the outer surfaces 36&38, respectively, of the locking ridge 28 and the seal skirt 32 and extend from the seal face 34 to the locking face 30 generally perpendicular to the plane of the lid main body. The ribs 39 define between each pair a vent whereby air may pass as the lid is pressed home.

Figure 9:
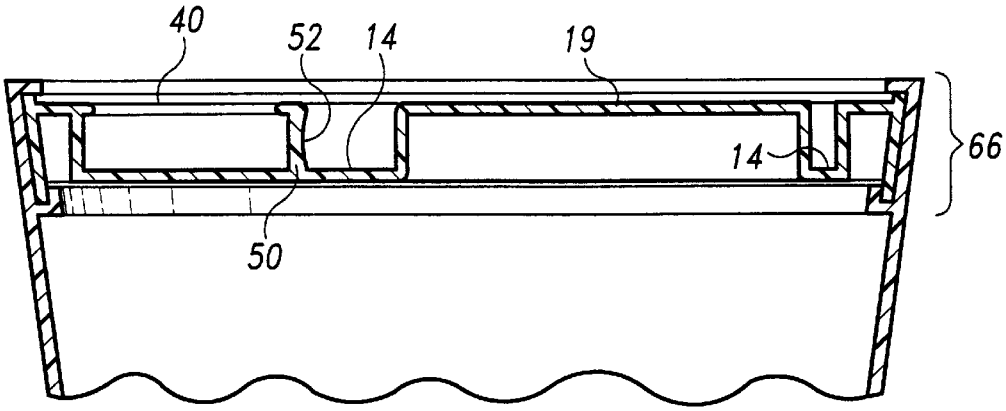
FIG. 9 is a cross section of the closure lid and container alternative embodiment taken along line 9—9 in FIG. 8.
Figure 10:
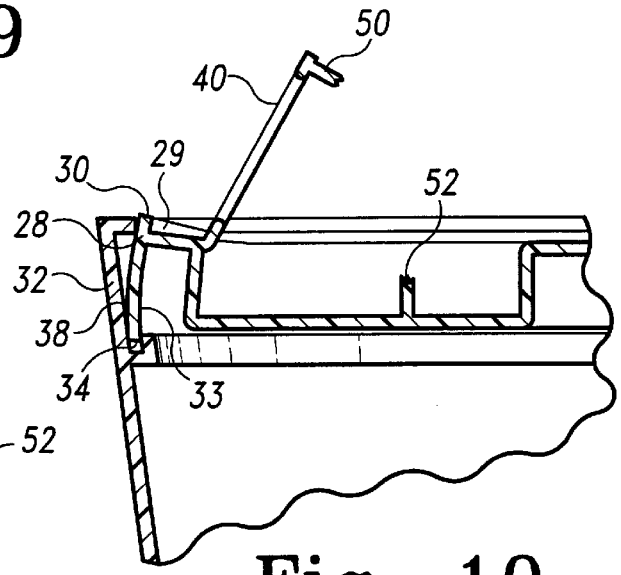
FIG. 10 is a partial cross section also taken along line 9—9 in FIG. 8 showing the frangible pin separated and the tab wall flexed to cause the lid locking ridge to move inwards of the locking ledge for removal of the lid from the container.

As the seal skirt is seated, the flared design of the outer surfaces 36&38 of the locking ridge 28 and seal skirt 32, respectively, come into pressing engagement first with the locking ledge 74, then snap beneath the locking ledge to seat against container inner wall surface 70 with the locking ridge locking face 30 in pressing engagement with the locking ledge locking face 76, as shown in FIGS. 3&9.

By virtue of the container lid design, a very stable closure seal is created for the container. The seal skirt 32, by virtue of its shape and complementary construction to the seal channel 80, creates a strong water-tight barrier to contained liquids while the locking ridge 28, by virtue of its shape and complimentary construction to the locking ledge lower face 76, inhibits translation of the lid toward the container mouth to maintain the integrity of the seal even during swelling of contained materials experienced during freezing. Further, the shape and size of the locking ridge removes any lid edge which could otherwise be grasped in an effort to remove the lid from the container.

Figure 12:
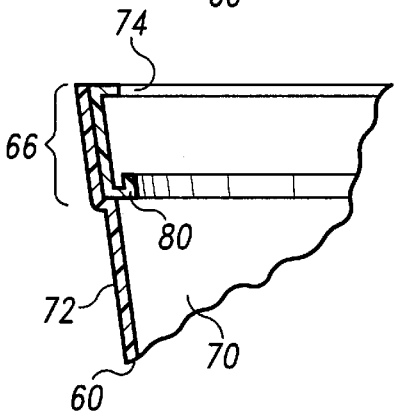
FIG. 12 is a partial cross section of an alternative embodiment of the lid and container in which the seal ring is constructed separately from the balance of the container, inserted into the container mouth and adhered in place.
Figure 8:
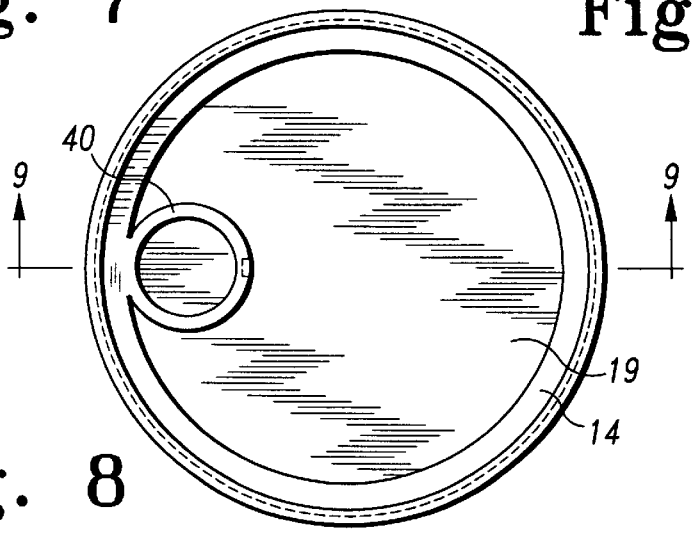
FIG. 8 is a top view of the closure lid and container alternative embodiment shown in FIG. 7.

Two additional embodiments pertinent to the novel container of the instant invention are appropriate for discussion at this juncture. Referring to FIG. 12, an alternative embodiment of the container disclosed in which the container is constructed in two pieces. The container lid ring 66 is constructed separately from the container itself and adhered to the inner wall surface 70 of the container adjacent the container mouth. While not essential to the practice of the invention, in the embodiment illustrated, the side wall 60 of the container is displaced outwardly along a distance back from the container mouth to create a step 90 on which the separately formed container lid ring will be positioned. The step 90 permits the proper positioning of the lid ring while not unduly extending the lid ring 66 into the otherwise open volume of the container, thus reducing interference with the removal of frozen contents.

This concept of a stepped container is carried into the second alternative embodiment of the container 12 which is disclosed in Fig, 16. In this embodiment, the lid ring 66 is offset outwardly from the general smooth upward slope of container wall 60. This outward setoff provides some additional rigidity to the lid ring 66 and moves the sealing and locking elements outward such that they do not extend toward the centerline of the container beyond the inner wall surface 70 beneath the lid ring 66. This creates a smooth inner wall surface to which the enclosed frozen contents can conform yet translate against without interference as the frozen contents is squeezed or shaken from the container, facilitating convenience in use and ease of access. The container embodiment of FIG. 16 also illustrates a variation on the seal channel 80. In this embodiment, a curved dimple ring 95 extends about the circumference of inner wall surface 70 at a position generally opposed to the top of the seal ring 78. In this embodiment, the dimple ring 95 presses against the outer surface 38 of the seal skirt 32 forcing the seal skirt inner surface 33 against the seal ring 78, creating an interference fit between the seal skirt 32 and the seal channel 80. This interference fit creates two seal boundaries between the lid 10 and the container 12. By incorporating the dimple ring, the seal face 34 of the seal skirt need not contact the seal base 84 to retain seal integrity.

To remove the lid 10 from the container 12, the consumer grasps the pull tab 40, pulling it inward and upward such that the hinging action of the tab wall 20 allows the translation of a segment of the locking ridge 28 from beneath the locking ledge 74 adjacent the pull tab location and further tension will cause the locking ridge to continue to translate from beneath the locking ledge 74 and which causes a segment of the seal skirt 38 to separate from its seat against the seal channel 80 beneath the pull tab location. Continued tension on the pull tab causes the lid sealing and locking elements to continue to separate outwardly from the originally translated segment from their counterparts inside the lid ring 66, ultimately resulting in the removal of the lid from the container. This is accomplished without damage or degradation to the closure lid locking ridge 28 or seal skirt 38, or to the container inner wall surface 70, the locking ledge 74 or the seal channel 80 such that the closure lid 10 may be reattached to the container 12 in sealed and locked relation thereto. Notably, during this operation, the frangible pin 50 separates providing a consumer clear visual evidence that the pull tab has been used.

A novel feature of the instant invention, particularly when viewed in light of present containers for frozen juices, is the ability to reseal the container with the closure lid. Since lid removal is accomplished without damage to the sealing and locking elements, the lid can be reinserted into the container to once again seal the container. Advantageously, the frangible pin 50 was separated at the time of initial removal. This both indicates tampering to the consumer but also provides a ready means of identifying a previously opened container from others with which it might be stored.

Because of the tapered shape of the container and the contour of the lid, the instant invention provides a stackable container, the lid 10 of one container 12 accepting the closed bottom 62 of another container 12 while inhibiting sideways translation of one container with respect to the other.

This detailed description addresses the invention in several embodiments. In the embodiments shown in FIGS. 1–11, the entire container and closure lid of the invention are constructed of the same selected thermoplastic material. In the embodiment shown in FIG. 12, the container can be and is illustrated as being of mixed material construction. The applicant recognizes and intends that the invention has equal application in products of even greater mixed material construction in which perhaps only the closure elements are constructed of a thermoplastic material suitably affixed to the materials making up the remainder of the container and lid, allowing, for example, the container to be constructed from glass and the lid main body to be constructed from metal.

It will be understood that the above description of the present invention is susceptible to various modifications, changes and adaptations, and the same are intended to be comprehended within the meaning and range of equivalents of the appended claims.

We claim:

1. For use with a container having a closed bottom and an open top defined by a rim between the outer surface and inner wall of the container, the container having a locking element about the periphery of the container inner wall adjacent the container rim and a sealing element about the periphery of the container inner wall distanced from the container rim a generally uniform greater distance than the locking element, a resealable container closure lid comprising:

a generally planar main body having a top side which is oriented away from the container bottom and a bottom side which is oriented toward the container bottom when the lid is inserted into the container;

a tab wall about the periphery of the main body projecting generally perpendicular to and upward from the top side of the main body;

a locking ridge surrounding the periphery of the main body, projecting generally perpendicular to the plane of the main body and extending upwardly with respect to the main body top side, the locking ridge having a locking face at its distal end generally parallel to the plane of the main body;

a seal skirt surrounding the periphery of the main body projecting generally perpendicular to the plane of the main body, and extending downwardly with respect to the main body bottom side, the seal skirt having a seal face at its distal end generally parallel to the plane of the main body; and means connecting the tab wall to the locking ridge and to the seal skirt, whereby, in inserting the closure lid into the container, the seal skirt projects the seal face into and in pressing releasable sealing engagement with the sealing element of the container while the locking ridge translates past the locking element and the locking face comes into releasable pressing engagement with a portion of the locking element to prevent translation of the lid away from the container sealing element;

a pull tab attached to a portion of the tab wall in raised relationship to the lid main body whereby the pull tab provides easy purchase to deform at least a portion of the tab wall causing a segment of the locking ridge face to unseat from the container locking element:

a pin spanning between the pull tab and the container main body and connected therebetween; and the pin including at least one area which is frangible, whereby the separation of the pin provides evidence of tampering, wherein the means connecting the tab wall to the locking ridge and to the seal skirt is a surround platform at the distal end of the tab wall which encircles and extends outwardly therefrom generally parallel to the plane of the lid main body and from which at the terminating edge thereof extend the locking ledge and the seal skirt, whereby the intersection of the tab wall and the surround platform form a hinge which imparts improved flexure to the container lid to reduce the effort required to deform a portion of the tab wall when the pull tab is used, wherein the outer surface of locking ridge and the outer surface of the seal skirt form a single contiguous outer surface, wherein the single contiguous outer surface is canted to flair from the seal face to the locking ridge face to improve the pressing engagement between the lid and container inner wall and facilitate the locking engagement between the locking face and the container locking element, wherein the single contiguous outer surface has at intervals a plurality of ribs extending from adjacent the seal face to adjacent the locking face which are relatively narrow with respect to the remaining portion of the contiguous outer surface and which project slightly away from the remaining portion of the contiguous outer surface, whereby the ribs define therebetween vents which permit air to escape as the closure lid is engaged with the container.

2. The container closure lid of claim 1 wherein the lid main body is upset to form a raised central platform which surrounds at least a portion of the pull tab, distanced slightly therefrom, and approximately the same height as the pull tab to provide protection against force inadvertently being applied to the pull tab.

3. The container closure lid of claim 1 wherein the locking ridge is segmented peripherally about the lid.

4. A sealable storage unit comprised of a lid and a container, the container having:

an outer surface and an inner wall;

a closed bottom and an open top, the open top defined by a rim between the outer surface and the inner wall;

locking means about the periphery of the container inner wall adjacent the container rim; and sealing means about the periphery of the container inner wall distanced from the container rim a generally uniform greater distance than the locking means, the lid comprising:

a generally planar main body having a top side which is oriented away from the container bottom and a bottom side which is oriented toward the container bottom when the lid is inserted into the container;

a tab wall about the periphery of the main body projecting generally perpendicular to and upward from the top side of the main body;

a locking ridge surrounding the periphery of the main body, projecting generally perpendicular to the plane of the main body and extending upwardly with respect to the main body top side, the locking ridge having a locking face at its distal end generally parallel to the plane of the main body;

a seal skirt surrounding the periphery of the main body projecting generally perpendicular to the plane of the main body, and extending downwardly with respect to the main body bottom side, the seal skirt having a seal face at its distal end generally parallel to the plane of the main body; and means connecting the tab wall to the locking ridge and to the seal skirt, whereby, interposing the lid in sealing relation to the container, the seal skirt projects the seal face into and in pressing releasable sealing engagement with the sealing means of the container while the locking ridge translates past the locking means and the locking face comes into releasable pressing engagement with the locking means to prevent translation of the lid away from the container, wherein the container locking means includes a locking ledge extending about the circumference of the inner wall surface adjacent the container rim in a plane substantially perpendicular to the centerline of the container protruding inwardly from the inner wall surface toward the centerline of the container and having on the surface facing the container bottom a relatively flat locking face;

whereby the locking face offers a locking surface to the lid locking ridge brought in pressing relation against the locking surface when the lid is interposed in the container in sealing relation to prevent translation of the lid outward from the container open top, wherein the lid further comprises a pull tab attached to a portion of the tab wall in raised relationship to the lid main body whereby the pull tab provides easy purchase to deform at least a portion of the tab wall causing a segment of the locking ridge face to unseat from the container locking ledge, wherein the lid further comprises (1) a pin spanning between the pull tab and the container main body and connected therebetween, and (2) the pin including at least one area which is frangible, whereby the separation of the pin provides evidence of tampering, wherein the means connecting the tab wall to the locking ridge and to the seal skirt is a surround platform at the distal end of the tab wall which encircles and extends outwardly from the tab wall generally parallel to the plane of the lid main body, the surround platform having the locking ledge and the seal skirt extending from the surround platform perimeter, whereby the intersection of the tab wall and the surround platform forms a living hinge which imparts improved flexure to the container lid, to reduce the effort required to deform a portion of the tab wall when the pull tab is used, wherein the outer surface of the locking ridge and the outer surface of the seal skirt form a single contiguous outer surface about the periphery of the lid, wherein the single contiguous outer surface of the lid is canted to flair from the seal face to the locking ridge face to improve pressing engagement between the lid and the container inner wall and locking engagement between the locking face and the container locking ledge, wherein the single contiguous outer surface has at intervals a plurality of ribs extending from adjacent the seal face to adjacent the locking face, each of the ribs being relatively narrow with respect to the remaining portion of the contiguous outer surface and project slightly away from the remaining portion of the contiguous outer surface, whereby the ribs define therebetween vents which permit air to escape as the lid is engaged with the container.

5. The sealable storage unit of claim 4, wherein the locking ridge is segmented peripherally about the lid.

* * * * *